US006531827B2

(12) United States Patent
Kawashima

(10) Patent No.: US 6,531,827 B2
(45) Date of Patent: Mar. 11, 2003

(54) ELECTROLUMINESCENCE DISPLAY WHICH REALIZES HIGH SPEED OPERATION AND HIGH CONTRAST

(75) Inventor: Shingo Kawashima, Tokyo (JP)

(73) Assignee: NEC Corporation, Tokyo (JP)

( * ) Notice: Subject to any disclaimer, the term of this patent is extended or adjusted under 35 U.S.C. 154(b) by 27 days.

(21) Appl. No.: 09/924,498

(22) Filed: Aug. 9, 2001

(65) Prior Publication Data

US 2002/0067134 A1 Jun. 6, 2002

(30) Foreign Application Priority Data

Aug. 10, 2000 (JP) ..... 2000/243375

(51) Int. Cl.[7] ..... G09G 3/10

(52) U.S. Cl. ..... 315/169.3; 315/169.1; 315/169.2; 345/76; 345/89; 345/98

(58) Field of Search ..... 315/169.1, 169.2, 315/169.3, 169.4; 345/89, 90, 98, 100, 101, 76, 204, 210, 214

(56) References Cited

U.S. PATENT DOCUMENTS

| | | | | |
|---|---|---|---|---|
| 4,893,060 A | * | 1/1990 | Ohba et al. | 315/169.3 |
| 4,963,861 A | * | 10/1990 | Thioulouse et al. | 345/81 |
| 6,175,193 B1 | * | 1/2001 | Kishita et al. | 315/169.3 |
| 6,271,812 B1 | * | 8/2001 | Osada et al. | 345/76 |
| 6,288,496 B1 | * | 9/2001 | Suzuki et al. | 315/169.3 |
| 6,369,516 B1 | * | 4/2002 | Iketsu et al. | 315/169.3 |
| 6,376,994 B1 | * | 4/2002 | Ochi et al. | 315/169.1 |

FOREIGN PATENT DOCUMENTS

| | | |
|---|---|---|
| JP | 11-45071 | 2/1999 |
| JP | 11-231834 | 8/1999 |
| JP | 11-282419 | 10/1999 |

* cited by examiner

*Primary Examiner*—Tan Ho
(74) *Attorney, Agent, or Firm*—McGinn & Gibb, PLLC

(57) ABSTRACT

An electroluminescence display is composed of an electroluminescence pixel and a driving circuit. The driving circuit drives the electroluminescence pixel to emit light. The driving circuit provides a first drive current, and then provides a second drive current for the electroluminescence pixel. The first drive current is larger than the second drive current, and increases depending on the second drive current.

12 Claims, 12 Drawing Sheets

ELECTROLUMINESCENCE DISPLAY WHICH REALIZES HIGH SPEED OPERATION AND HIGH CONTRAST

BACKGROUND OF THE INVENTION

1. Field of the Invention

The present invention relates to an electroluminescence display (hereafter, referred to as an EL display). More particularly, the present invention relates to an electroluminescence display including a drive circuit that drives EL pixels at a high speed.

2. Description of the Related Art

An EL display has been widely used. FIG. 1 shows the configuration of a matrix type organic EL display. A driving circuit 101 is connected to organic EL pixels 102. The organic EL pixel 102 is connected to a horizontal drive switch 103. The horizontal drive switch 103 is connected to a ground terminal 104 and a power supply 105.

The driving circuit 101 drives one of the organic EL pixels 102 connected thereto. Which one of the organic EL pixels 102 is driven is determined by the horizontal drive switch 103. The organic EL pixel 102 is connected to any one of the ground terminal 104 and the power supply 105 by the horizontal drive switch 103, and a drive current flows through the organic EL pixel 102 connected to the ground terminal 104. That is, the organic EL pixel 102 connected to the ground terminal 104 is driven by the driving circuit 101.

On the other hand, the drive current does not flow through the organic EL pixel 102 connected to the power supply 105.

FIG. 2 shows the structure of each organic EL pixel 102. An anode 109., an organic film 110 and a cathode 111 are formed in turn on a transparent substrate 108. Electroluminescence phenomenon causes the organic film 110 to emit a light.

FIG. 3 shows the equivalent circuit of the organic EL pixel 102. The organic EL pixel 102 is represented by the circuit in which a parasitic capacitor 112 and a light emitting diode 113 are connected parallel to each other. The parasitic capacitor 112 indicates a capacitance formed between the anode 109 and the cathode 111. A thickness of the organic film 110 is thin, typically ranging from 100 nm to 200 nm. The parasitic capacitor 112 typically has a capacitance of about 3 to 4 pF when a pixel size is 0.03 square millimeters.

FIG. 4 shows the dependency between a light emission intensity of the organic EL pixel 102 and a voltage applied to the organic EL pixel 102. The organic EL pixel 102 emits light when the voltage applied thereto exceeds a light emission start voltage $V_T$. The light emission start voltage $V_T$ depends on color of the light, ranging from 5 to 10 V. It is necessary to charge the parasitic capacitor 112 of the organic EL pixel 102 to the light emission start voltage $V_T$ in order that the organic EL pixel 102 emits the light. A rapid charge of the parasitic capacitor 112 shortens the time necessary for the light emission of the organic EL pixel 102.

A light emitting display is disclosed in Japanese Laid Open Patent Application (JP-A-Heisei, 11-231834), in which a parasitic capacitor of an EL pixel is charged at a high speed. In the conventional light emitting display, the time necessary for the light emission of the EL element is shortened by the following operation. When a drive is started, a constant charge voltage is firstly applied to the EL pixel to charge the parasitic capacitor. The charge voltage is selected such that the parasitic capacitor is charged at the high speed. In succession, a drive current to enable the light emission of a desirable intensity flows through the EL pixel. The time necessary for the light emission of the EL element is shortened by charging the parasitic capacitor at the high speed.

However, it is difficult that the conventional light emitting display has a high contrast. In order that the EL pixel emits a light at a high intensity, it is necessary to increase a charge voltage applied when the drive is started. However, the increase in the charge voltage disables the EL pixel to emit the light at a low intensity, because at least the charge voltage is applied to the EL pixel. On the other hand, if the charge voltage is decreased such that the EL pixel can emit the light at the low intensity, the EL pixel can not emit the light at the high intensity.

It is desirable that the EL display has a high contrast.

Also, the conventional light emitting display is susceptible to the influence from an ambient temperature. As shown in FIG. 5, an intensity—drive voltage property of an EL pixel is largely varied depending on the ambient temperature. The light emission intensity of the EL pixel largely depends on the ambient temperature, because the constant charge voltage is applied to the EL pixel light emitting display when the drive is started.

Moreover, the variation in the ambient temperature causes the tonality to be changed. This is because the variation degree of the intensity—drive voltage property of the EL pixel with respect to the ambient temperature is different depending on the light emission color of the EL pixel.

It is desirable that the EL display is not susceptible to the influence from the ambient temperature. In particular, it is desirable that the light emission intensity and the tonality are not susceptible to the influence from the ambient temperature.

Other techniques for driving EL pixels are disclosed in Japanese Open Laid Patent Application (JP-A-Heisei 11-45071, and JP-A-Heisei 11-282419). However, these techniques do not solve the above-mentioned problems.

SUMMARY OF THE INVENTION

Therefore, an object of the present invention is to increase a contrast of an EL display.

Another object of the present invention is to provide an EL display in which a time necessary for a light emission is shorten and a contrast is high.

Still another object of the present invention is to provide an EL display that is not susceptible to an influence from an ambient temperature.

Still another object of the present invention is to provide an EL display in which a time necessary for a light emission is shortened and it is not susceptible to an influence from an ambient temperature.

In order to achieve an aspect of the present invention, an electroluminescence display is composed of an electroluminescence pixel and a driving circuit. The driving circuit drives the electroluminescence pixel to emit light. The driving circuit provides a first drive current, and then provides a second drive current for the electroluminescence pixel. The first drive current is larger than the second drive current, and increases depending on the second drive current.

The second drive current is preferably determined based on a brightness of the light.

Also, the first drive current is preferably smaller than a limit current for maintaining a current-brightness property of the electroluminescence pixel substantially linear.

Preferably, the first drive current is k times as large as the second drive current, where k is a constant larger than 1.

The k is preferably defined such that $$k \leqq I_{max}/I_{out2\text{-}max},$$

where $I_{max}$ is a limit current for maintaining a current-brightness property of the electroluminescence pixel substantially linear, and $I_{out2\text{-}max}$ is a maximum value of the second drive current.

The k is preferably determined based on a color of light emitted by the electroluminescence pixel.

The driving circuit preferably includes a first current source unit generating a first current, a second current source unit generating a second current, and a current output unit superposing the first and second current to generate the first drive current.

The current output unit preferably generates the second drive current from the first current.

In order to achieve another aspect of the present invention, a method of operating a electroluminescence display is composed of:

providing a first drive current with a electroluminescence pixel; and providing a second drive current with the electroluminescence pixel after the providing the first drive current. The first drive current is larger than the second drive current, and increases depending on the second drive current.

DESCRIPTION OF THE PREFERRED EMBODIMENTS

An EL display of an embodiment according to the present invention will be described below with reference to the attached drawings.

First Embodiment

Figure 1:
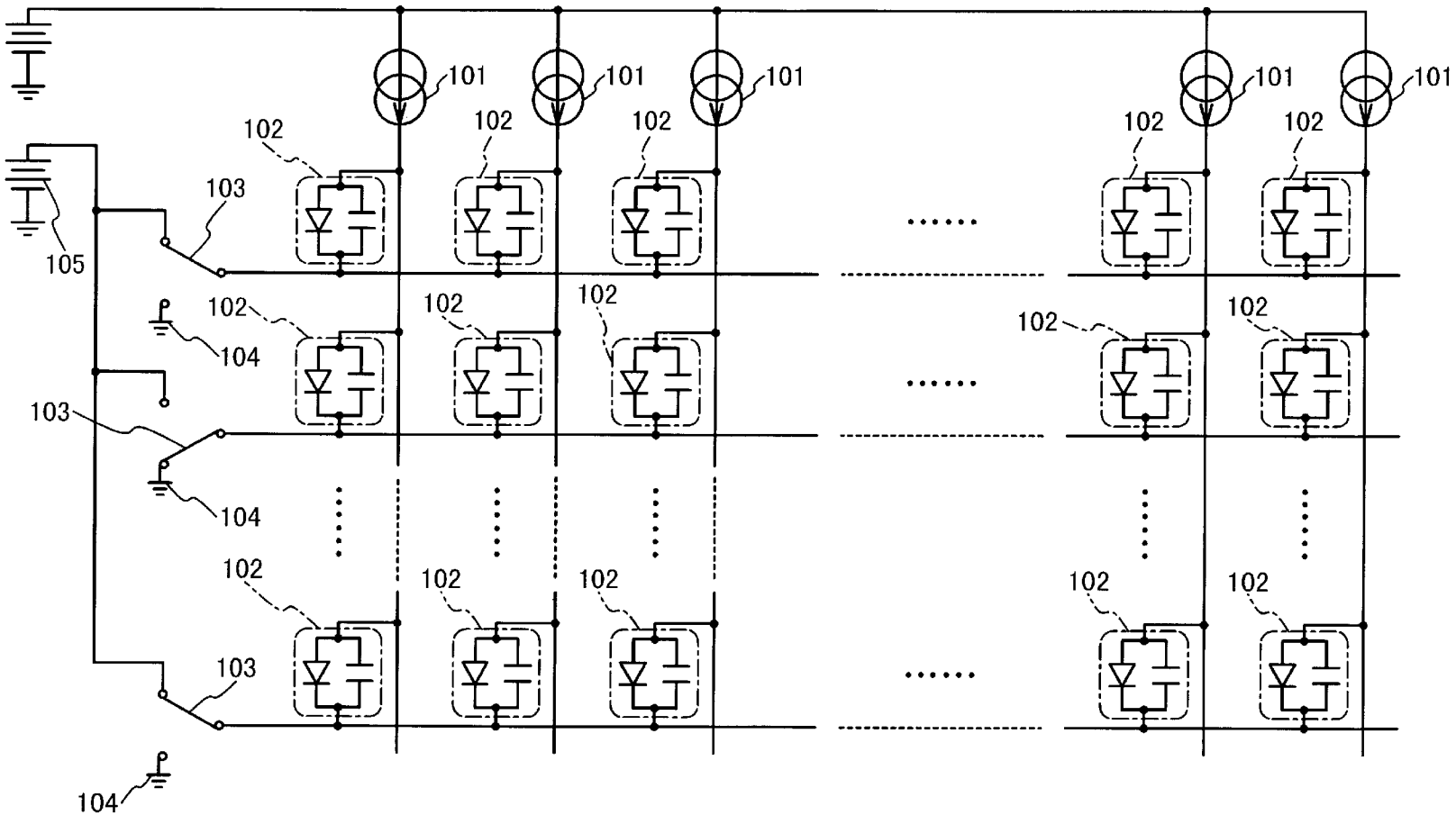
Fig. 1 PRIOR ART
FIG. 1 shows a configuration of a conventional EL display.
Figure 2:
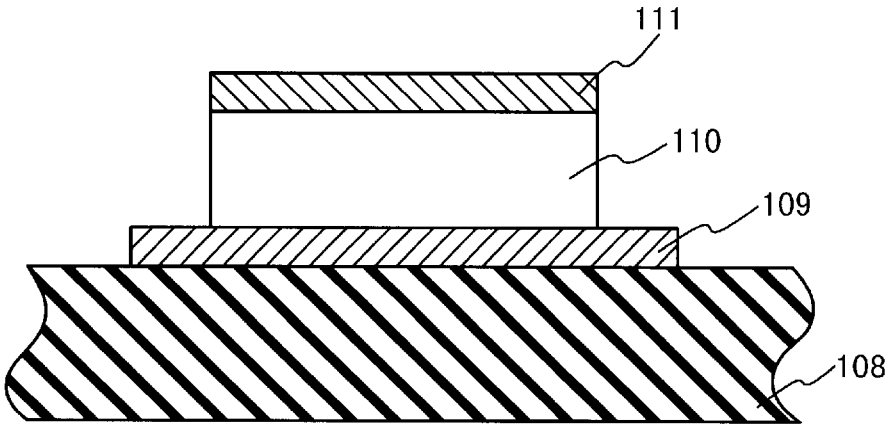
Fig. 2 PRIOR ART
FIG. 2 shows a configuration of an organic EL pixel 102.
Figure 3:
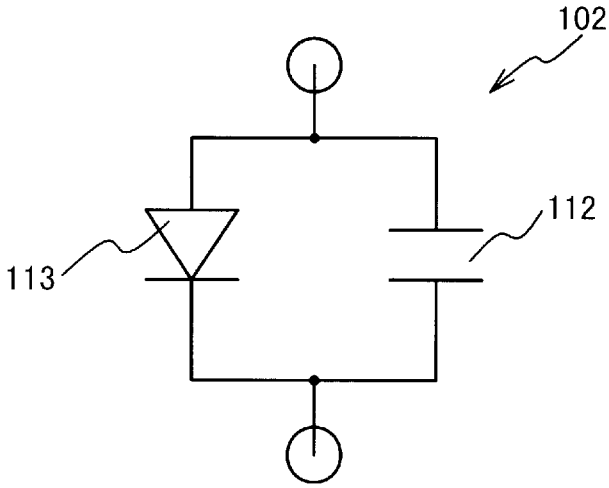
Fig. 3 PRIOR ART
FIG. 3 shows an equivalent circuit of the organic EL pixel 102.
Figure 4:
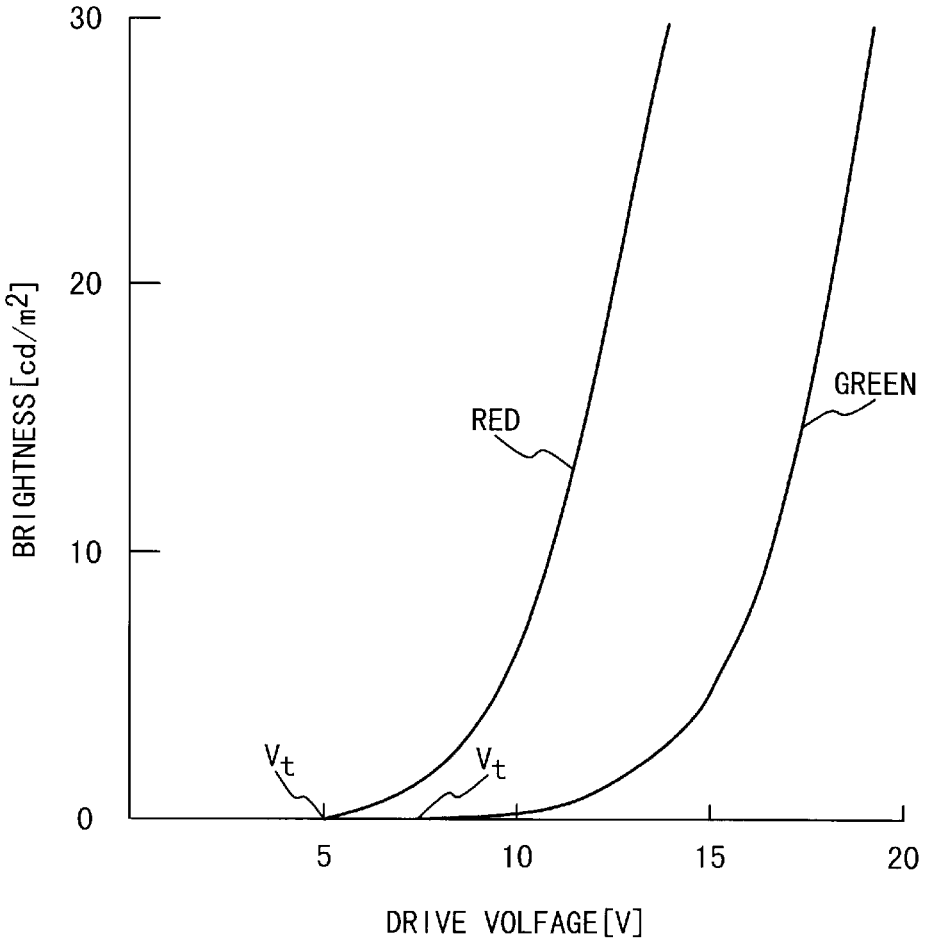
Fig. 4 PRIOR ART
FIG. 4 shows a dependency between a light emission intensity of the organic EL pixel 102 and a voltage applied to the organic EL pixel 102.
Figure 5:
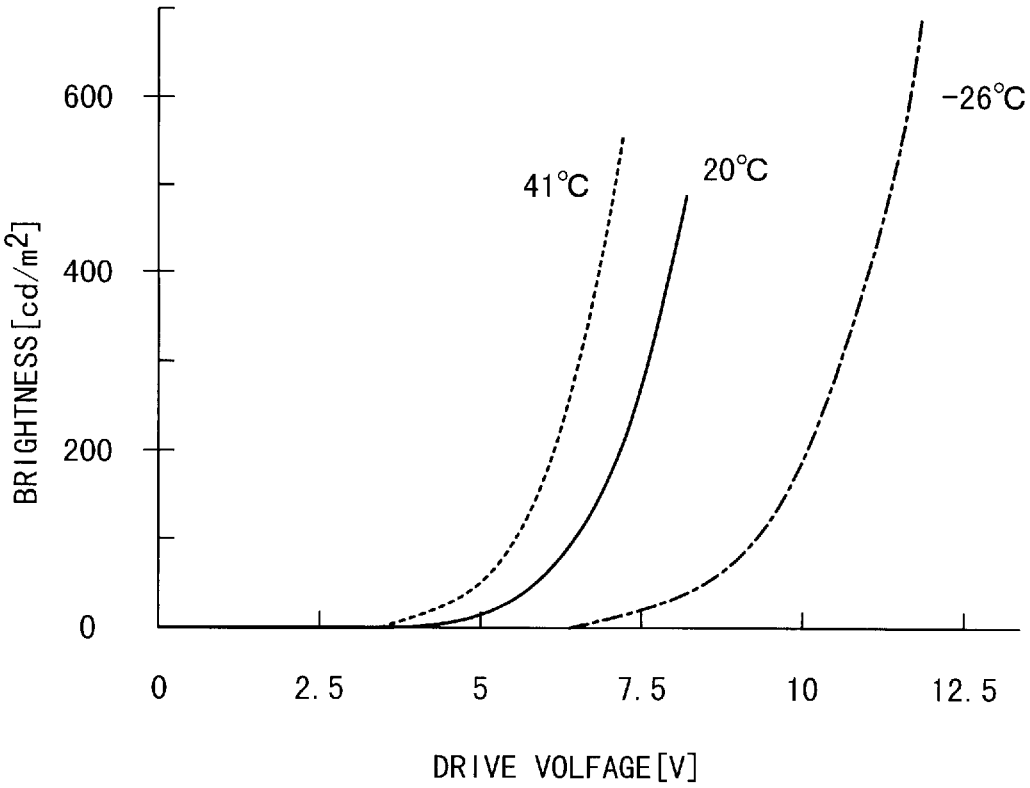
FIG. 5 shows an intensity—drive voltage property of an EL pixel.
Figure 6:
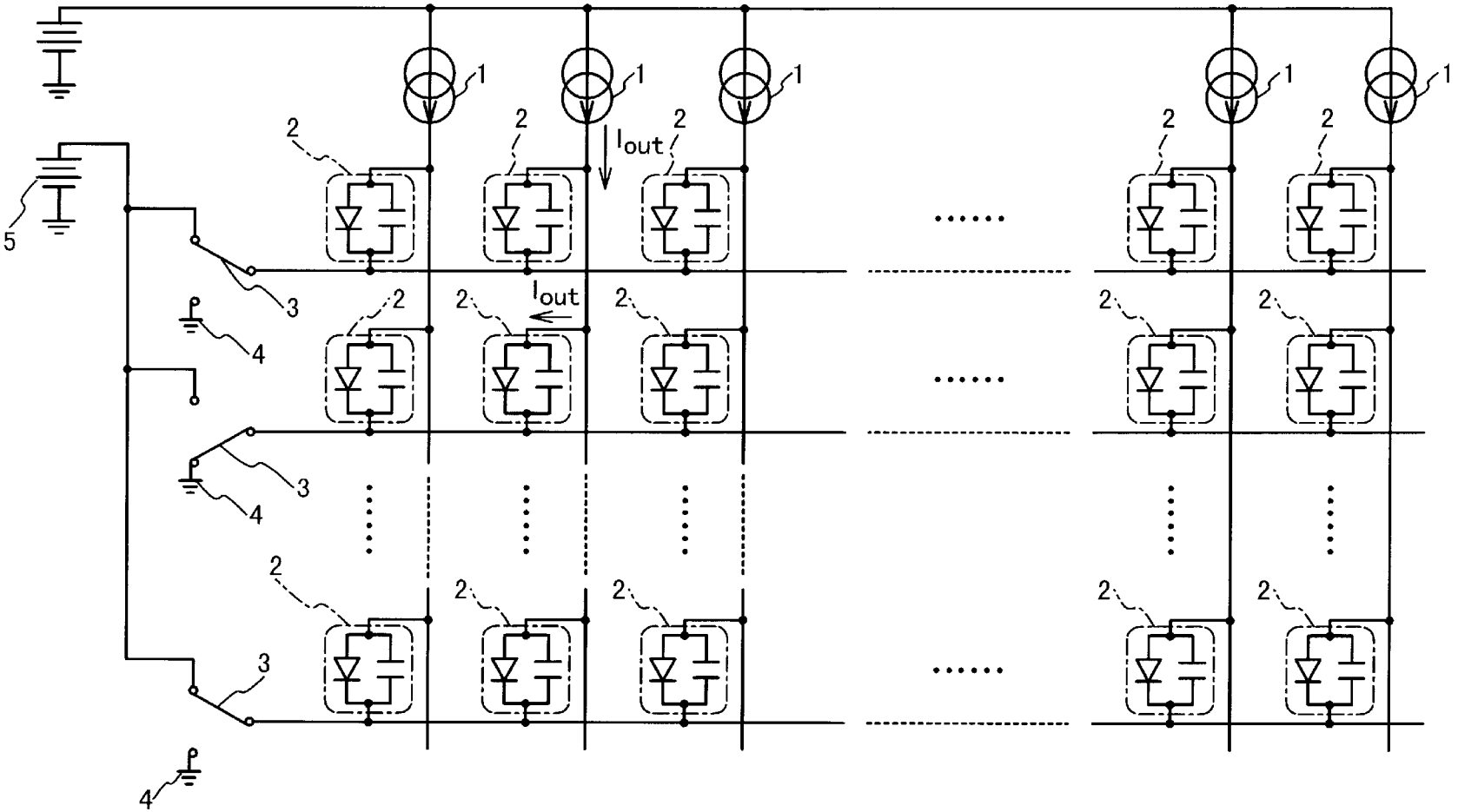
FIG. 6 shows a configuration of an EL display of an embodiment according to the present invention.

FIG. 6 shows the configuration of an organic EL display of a first embodiment. The organic EL display is provided with driving circuits 1, organic EL pixels 2, horizontal drive switches 3, a ground terminal 4 and a power supply 5.

The driving circuit 1 is connected to the organic EL pixels 2. The organic EL pixel 2 is connected to the horizontal drive switch 3. The horizontal drive switch 3 is connected to the ground terminal 4 and the power supply 5.

The driving circuit 1 drives one of the organic EL pixels 2 connected thereto. Which one of the organic EL pixels 2 is driven is determined by the horizontal drive switch 3. The organic EL pixel 2 is connected to any one of the ground terminal 4 and the power supply 5 by using the horizontal drive switch 3, and a drive current flows through the organic EL pixel 2 connected to the ground terminal 4. That is, the organic EL pixel 2 connected to the ground terminal 4 is driven by the driving circuit 1. On the other hand, the drive current does not flow through the organic EL pixel 2 connected to the power supply 5.

Figure 7:
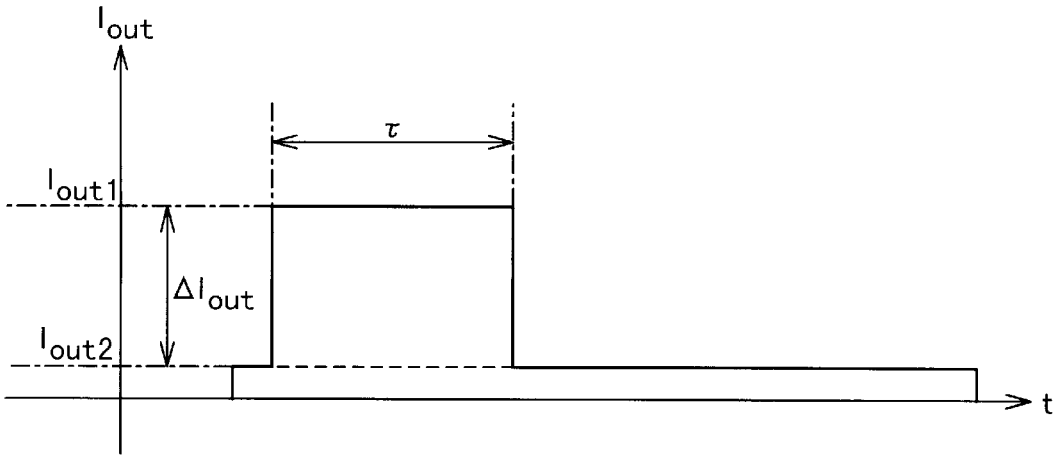
FIG. 7 shows a waveform of a drive current $I_{out}$ that a driving circuit 1 outputs to an organic EL pixel 2.

FIG. 7 shows a waveform of the drive current $I_{out}$, which the driving circuit 1 outputs to the organic EL pixel 2, when the organic EL pixel 2 is driven. When the drive of the organic EL pixel 2 is started, the charge drive current $I_{out1}$ flows through the organic EL pixel 2 only for a time $\tau$. The parasitic capacitor of the organic EL pixel 2 is charged by the charge drive current $I_{out1}$.

In succession, a light emission drive current $I_{out2}$ flows through the organic EL pixel 2. The light emission drive current $I_{out2}$ is determined such that the organic EL pixel 2 emits a light at a desirable intensity, on the basis of the current—intensity property of organic EL pixel 2. At this time, the charge drive current $I_{out1}$ is greater by $\Delta I_{out}$ than the light emission drive current $I_{out2}$.

Figure 8A:
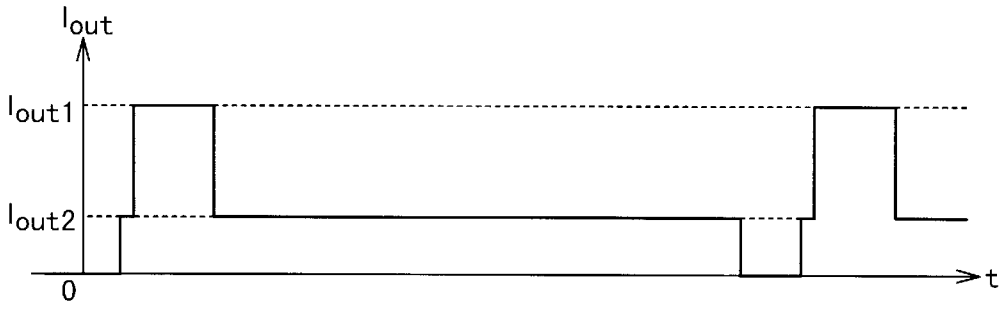
FIG. 8A shows a waveform of a drive current $I_{out}$.
Figure 8B:
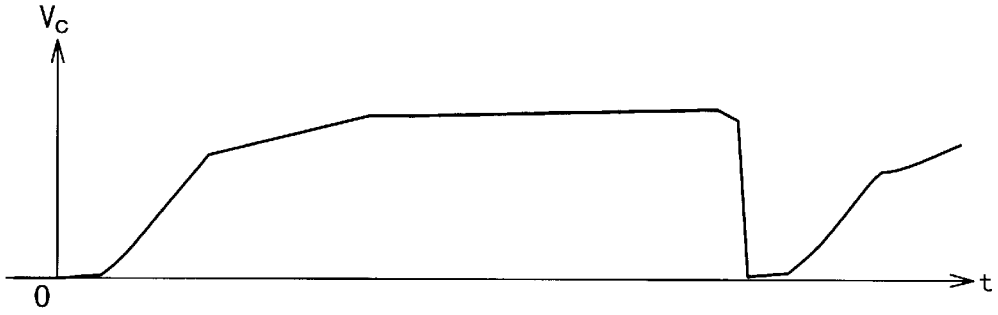
FIG. 8B shows a waveform of a terminal voltage $V_c$ of the organic EL pixel 2.
Figure 8C:
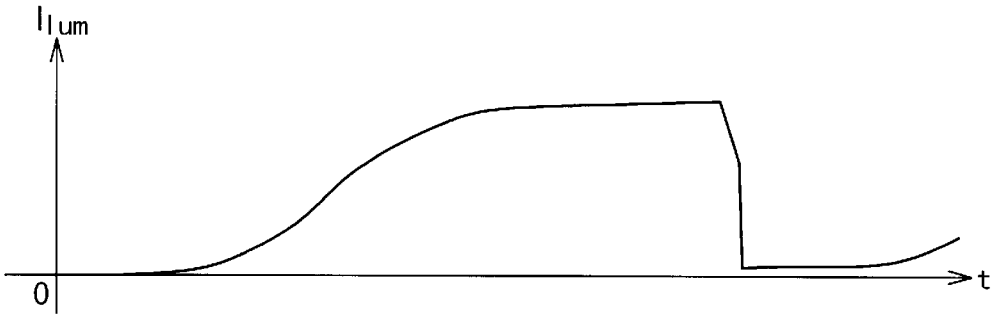
FIG. 8C shows a waveform of a current $I_{lum}$ contributing to a light emission among the currents flowing through the organic EL pixel 2.
Figure 9:
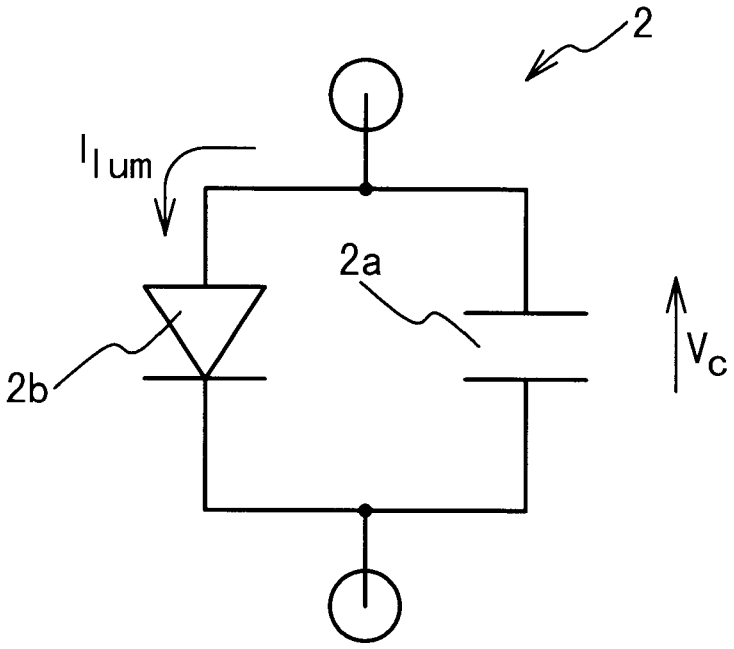
FIG. 9 shows an equivalent circuit of the organic EL pixel 2.

FIGS. 8A, 8B and 8C show a waveform of a drive current $I_{out}$, a waveform of a terminal voltage $V_c$ of the organic EL pixel 2 when the drive current Iout is outputted to the organic EL pixel 2, and a waveform of a current $I_{lum}$ contributing to the light emission among the currents flowing through the organic EL pixel 2, respectively. Here, let us suppose that the organic EL pixel 2 is represented by the equivalent circuit shown in FIG. 9. The terminal voltage $V_c$ corresponds to a voltage applied to a parasitic capacitor 2*a*. Moreover, the current $I_{lum}$ corresponds to a current flowing through a light emitting diode 2*b*.

As shown in FIG. 8A, when the drive of the organic EL pixel 2 is started, the charge drive current $I_{out1}$ flows as the drive current $I_{out}$. Accordingly, the parasitic capacitor 2*a* is quickly charged to thereby increase the terminal voltage $V_c$ at a high speed. After the terminal voltage $V_c$ is risen up, the current $I_{lum}$ is increased as shown in FIG. 8C. The current $I_{lum}$ is substantially equal to the light emission drive current $I_{out2}$ after being saturated.

The charge drive current $I_{out1}$ increased depending on the light emission drive current $I_{out2}$. It is designed such that the greater the light emission drive current $I_{out2}$, the greater the charge drive current $I_{out1}$. This implies the design in which as the organic EL pixel 2 emits the light at a higher intensity, the charge drive current $I_{out1}$ becomes greater. The thus-determined design of the charge drive current $I_{out1}$ contributes to the higher contrast of the organic EL display. Moreover, this design contributes to the little influence of an ambient temperature on the organic EL display.

Figure 10:
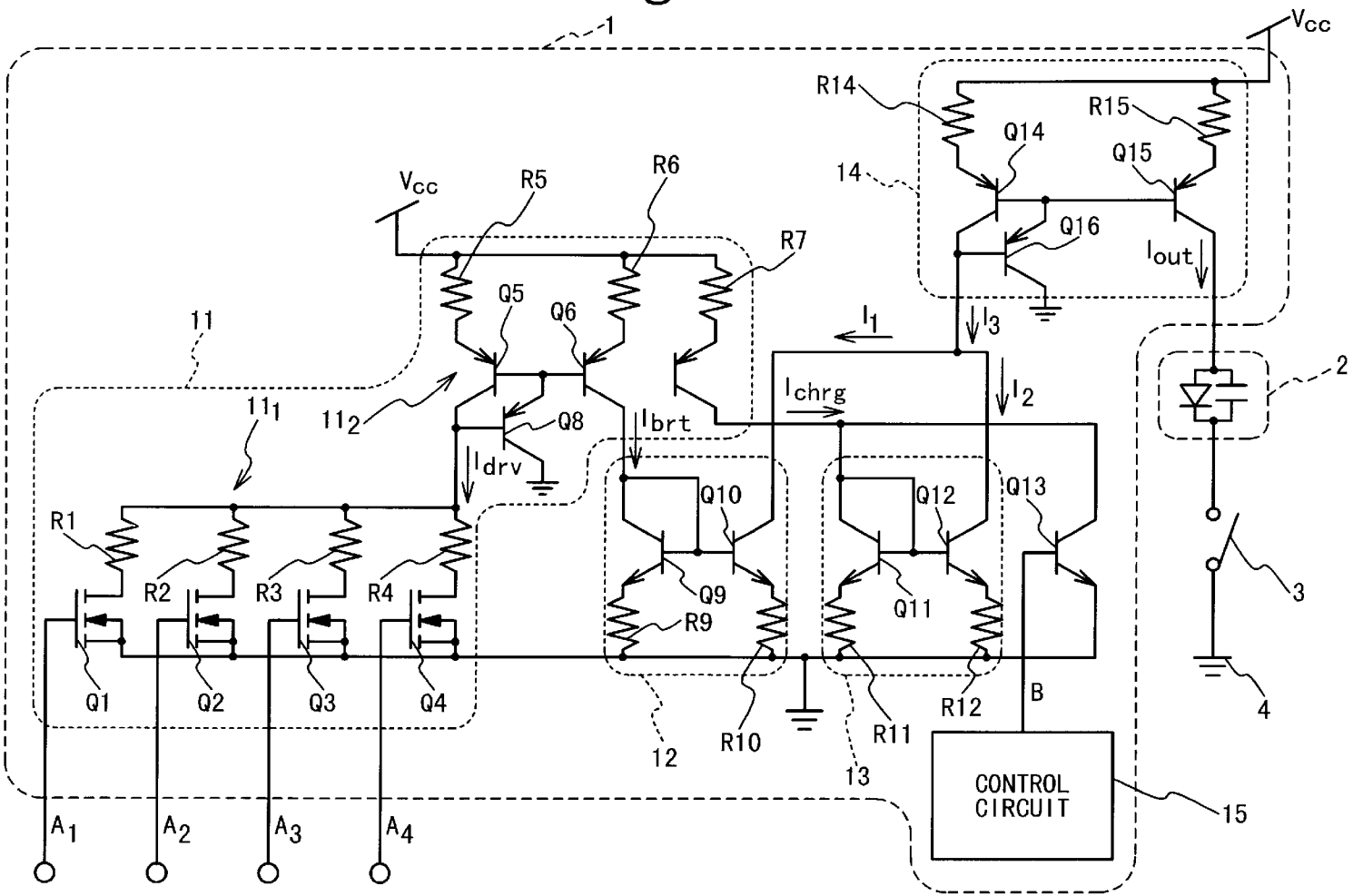
FIG. 10 shows a configuration of the driving circuit 1.

FIG. 10 shows the driving circuit 1 for outputting the drive current $I_{out}$. The driving circuit 1 includes a signal current generator 11, current mirrors 12, 13 and 14, a controller 15 and a transistor Q13. The driving circuit 1 outputs the drive current Iout to the organic EL pixel 2 and drives the organic EL pixel 2.

The signal current generator 11 contains a digital-analog converter $\mathbf{11}_1$ and a current mirror $\mathbf{11}_2$ The digital-analog converter $\mathbf{11}_1$ includes transistors Q1 to Q4 and resistors R1 to R4. The current mirror 112 includes transistors Q5 to Q8 and resistors R5 to R7.

The digital-analog converter $\mathbf{11}_1$ draws out a drive current indication current $I_{drv}$ from the current mirror $\mathbf{11}_2$. The intensity of the drive current indication current $I_{drv}$ is determined on the basis of current setting digital signals $A_1$ to $A_4$. The drive current indication current $I_{drv}$ is determined so as to be proportional to the light emission drive current $I_{out2}$.

The current mirror $\mathbf{11}_2$ outputs a light emission current indication current $I_{brt}$ and a charge current indication current $I_{chrg}$, based on the drive current indication current $I_{drv}$. The light emission current indication current $I_{brt}$ is equal to $a_1$ times the drive current indication current $I_{drv}$. The charge current indication current $I_{chrg}$ is equal to $a_2$ times the drive current indication current $I_{drv}$. The light emission current indication current $I_{brt}$ determines the light emission drive current $I_{out2}$ in the drive current $I_{out}$. The charge current indication current $I_{chrg}$ determines a difference $\Delta I_{out}$ between the charge drive current $I_{out1}$, and the light emission drive current $I_{out2}$.

The light emission current indication current $I_{brt}$ flows into the current mirror 12. The current mirror 12 is composed of transistors Q9, Q10 and resistors R9, R10. The current mirror 12 draws out a current $I_1$ equal to $b_1$ times the light emission current indication current $I_{brt}$ from the current mirror 14.

On the contrary, the charge current indication current $I_{chrg}$ flows into the current mirror 13 or the transistor Q13, on the basis of a charge control signal B outputted by the control circuit 15. If the transistor Q13 is turned on in response to the charge control signal B, the charge current indication current $I_{chrg}$ flows into the transistor Q13, and does not flow into the current mirror 13. On the other hand, if the transistor Q13 is turned off in response to the charge control signal B, the charge current indication current $I_{chrg}$ flows into the current mirror 13.

The current mirror 13 is composed of transistors Q11, Q12 and resistors R11, R12. The current mirror 13 draws out a current equal to $b_2$ times the current flowing thereto, from the current mirror 14. The current mirror 13 causes a current $I_2$ drawn out from the current mirror 14 to be equal to $b_2$ times the charge current indication current $I_{chrg}$, or the current mirror 13 draws out no current from the current mirror 14, which leads to the $I_2=0$.

The currents $I_1$, $I_2$ are superposed on each other and become a current $I_3$. The current mirrors 12, 13 cause the current $I_3$ to be drawn out from the current mirror 14.

The current mirror 14 is composed of transistors Q14 to Q16 and resistors R14, R15. The current mirror 14 outputs a current equal to c times the current $I_3$ as the drive current $I_{out}$ to the organic EL pixel 2. That is, the drive current $I_{out}$ becomes the current in which the current equal to c times the current $I_1$ and the current equal to c times the current $I_2$ are superposed on each other.

The operations of the respective sections of the driving circuit 1 when the organic EL pixel 2 is driven is described below.

When the drive of the organic EL pixel 2 is started, the transistor Q13 is turned off by the charge control signal b. In addition, the light emission drive current $I_{out2}$ is specified by the current setting digital signals a1 to a4. The light emission drive current $I_{out2}$ is determined on the basis of an intensity of a light emitted by the organic EL pixel 2. In response to the current setting digital signals $A_1$ to $A_4$, the drive current indication current $I_{drv}$ corresponding to the light emission drive current $I_{out2}$ is drawn out from the current mirrors $\mathbf{11}_2$ by the digital-analog converter $\mathbf{11}_1$. The light emission current indication current $I_{brt}$ and the charge current indication current $I_{chrg}$ are outputted from the current mirrors $\mathbf{11}_2$. That is, they are represented by:

$$I_{brt}=a_1 \cdot I_{drv},$$

$$I_{chrg}=a_2 \cdot I_{drv}.$$

The light emission current indication current $I_{brt}$ is outputted to the current mirror 12. The current mirror 12 draws out the current $I_1$, equal to $b_1$ times the light emission current indication current $I_{brt}$ from the current mirror 14. Moreover, since the transistor Q13 is turned off, the charge current indication current $I_{chrg}$ is outputted to the current mirror 13. Then, the current $I_2$ equal to $b_2$ times the light emission current indication current $I_{brt}$ is drawn out from the current mirror 14. That is, they are represented by:

$$I_1=a_1 \cdot b_1 \cdot I_{drv},$$

$$I_2=a_2 \cdot b_2 \cdot I_{drv}.$$

Here, the $I_3$ is represented by:

$$I_3=I_1+I_2=(a_1 \cdot b_1+a_2 \cdot b_2)I_{drv}.$$

Thus, the charge drive current $I_{out1}$ outputted to the organic EL pixel 2 immediately after the start of the drive of the organic EL pixel 2 is represented by:

$$I_{out1}=c \cdot I_3=(a_1 \cdot b_1+a_2 \cdot b_2) \cdot c \cdot I_{drv}.$$

The charge drive current $I_{out1}$ is outputted to the organic EL pixel 2 only for the predetermined time $\tau$. It is desirable that the charge drive current $I_{out1}$ continues to flow until a voltage between the terminals of the organic EL pixel 2 exceeds the light emission start voltage $V_T$.

After that, the transistor Q13 is turned on by the charge control signal B. The charge current indication current $I_{chrg}$ flows into the transistor Q13, and it does not flow into the current mirror 13. Thus, $I_2=0$.

The light emission drive current $I_{out2}$ is represented by:

$$I_{out2}=c \cdot I_3=a_1 \cdot b_1 \cdot c \cdot I_{drv}.$$

The light emission drive current $I_{out2}$ is selected such that the organic EL pixel 2 emits the light having a desirable intensity when the light emission drive current $I_{out2}$ flows through the organic EL pixel 2. The drive current indication current $I_{drv}$ is determined correspondingly to the light emission drive current $I_{out2}$.

At this time, the charge drive current $I_{out1}$ is represented by:

$$I_{out1}=k \cdot I_{out2},$$

$$k=(a_1 \cdot b_1+a_2 \cdot b_2)/(a_1-b_1).$$

In this way, the charge drive current $I_{out1}$ is determined such that the charge drive current $I_{out1}$ increases depending on the light emission drive current $I_{out2}$. That is, it is designed such that as the organic EL pixel 2 emits the light at the higher intensity, the charge drive current $I_{out1}$ becomes greater.

The above-mentioned operation of the driving circuit 1 improves the contrast of the EL display. The charge drive current $I_{out1}$ is determined on the basis of the intensity of the light emitted by the organic EL pixel 2. If the organic EL pixel 2 emits the light at the higher intensity, the charge drive current $I_{out1}$ is also greater so that the organic EL pixel 2 is charged to a high terminal voltage. On the other hand, if the organic EL pixel 2 emits the light at the low intensity, the charge drive current $I_{out1}$ is also smaller so that the organic EL pixel 2 is charged to a low terminal voltage. Thus, it is possible to widen the range of the intensity at which the EL display can emit the light. That is, it is possible to increase the contrast of the EL display.

Moreover, the influence of the ambient temperature on the EL display is suppressed. This is because the organic EL pixel 2 is driven by the current. As mentioned above, the brightness—drive voltage property of the EL pixel is largely varied with regard to the ambient temperature. However, the drive current—brightness property of the EL pixel is not easily varied with regard to the ambient temperature. Thus, the influence of the ambient temperature on the EL display can be reduced by the mechanism that the organic EL pixel 2 is perfectly driven by the current.

Figure 11:
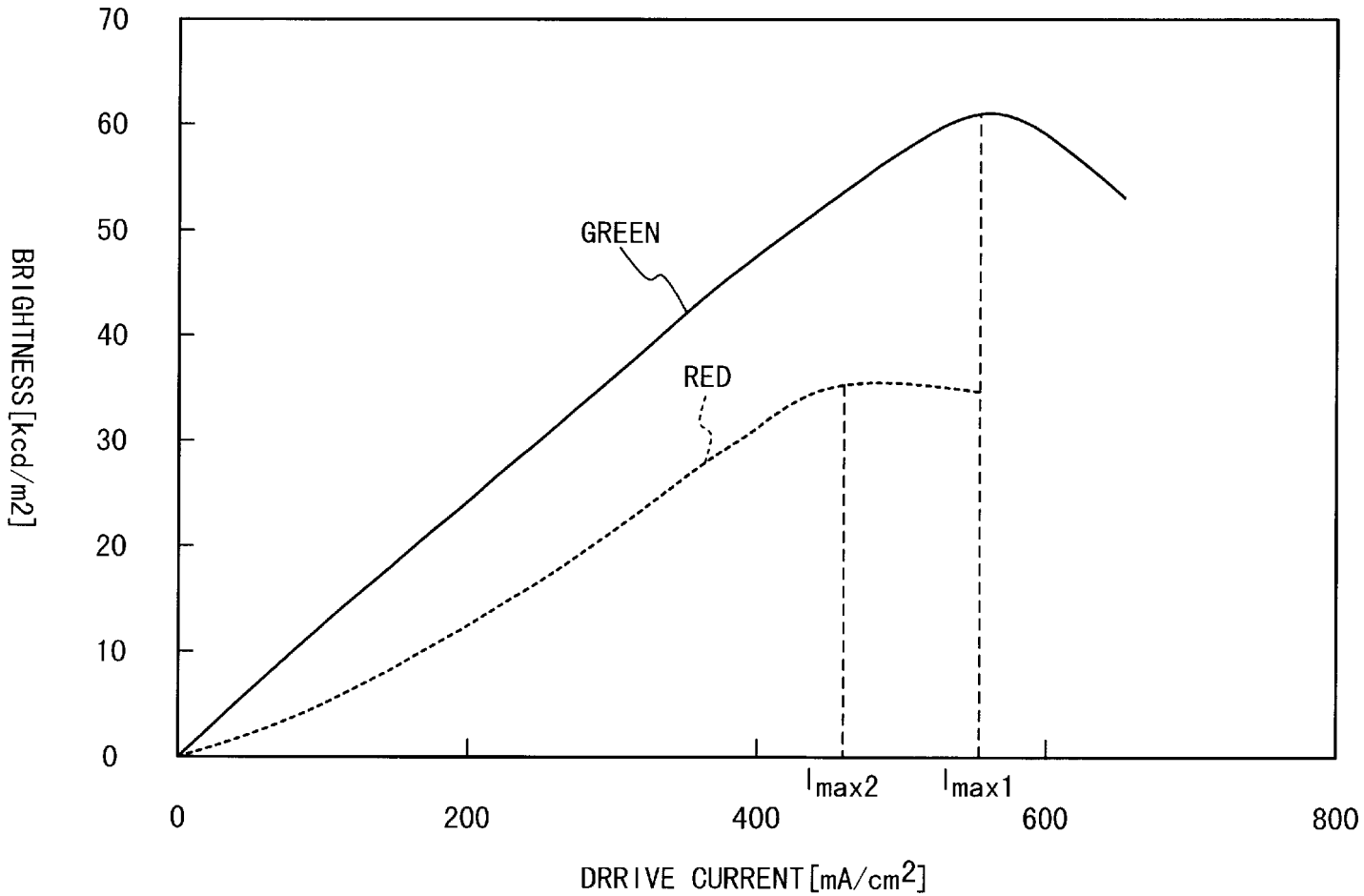
FIG. 11 shows a current—intensity property of the organic EL pixel 2.

Here, it is desirable that the charge drive current $I_{out1}$ is determined within the following range. FIG. 11 shows the current—brightness property of the organic EL pixel 2. Let us consider the case of the light emission of green. The intensity of the organic EL pixel 2 is substantially linearly changed with respect to the current flowing into it, within the range smaller than the limit current $I_{max1}$. If the current flowing into the organic EL pixel 2 exceeds the limit current $I_{max1}$, the intensity of the organic EL pixel 2 is decreased. If the current exceeding the limit current $I_{max1}$ flows into the organic EL pixel 2, the organic EL pixel 2 is suddenly deteriorated. The charge drive current $I_{out1}$ is desired to be smaller than the limit current $I_{max1}$ implying the maximum current under which the current—intensity property of the organic EL pixel 2 can hold its substantial linearity.

At this time, the above-mentioned k ($=I_{out1}/I_{out2}$) is desired to be determined so as to satisfy the following equation:

$$k \leqq I_{max1}/I_{out2\text{-}max}$$

Here, the $I_{out2\text{-}max}$ is the maximum value of the light emission drive current $I_{out2}$, namely, the light emission drive current $I_{out2}$ when the organic EL pixel 2 emits the light while the intensity is kept at a maximum. Such determination of the k prevents the organic EL pixel 2 from being uselessly deteriorated.

As for the organic EL pixel 2 emitting red light, the k is also determined in the above-mentioned manner. In this case, the charge drive current $I_{out1}$ is desired to be smaller than the maximum limit current $I_{max2}$ implying the maximum current under which the current—brightness property of the organic EL pixel 2 holds its substantial linearity. Moreover, it is desirable that $A \leqq I_{max2}/I_{out2\text{-}max}$.

The limit current implying the maximum current under which the current—intensity property of the organic EL pixel 2 holds its substantial linearity is different depending on the color of the light emission. Thus, the k is desired to be determined on the basis of the color of the light emission.

Second Embodiment

Figure 12:
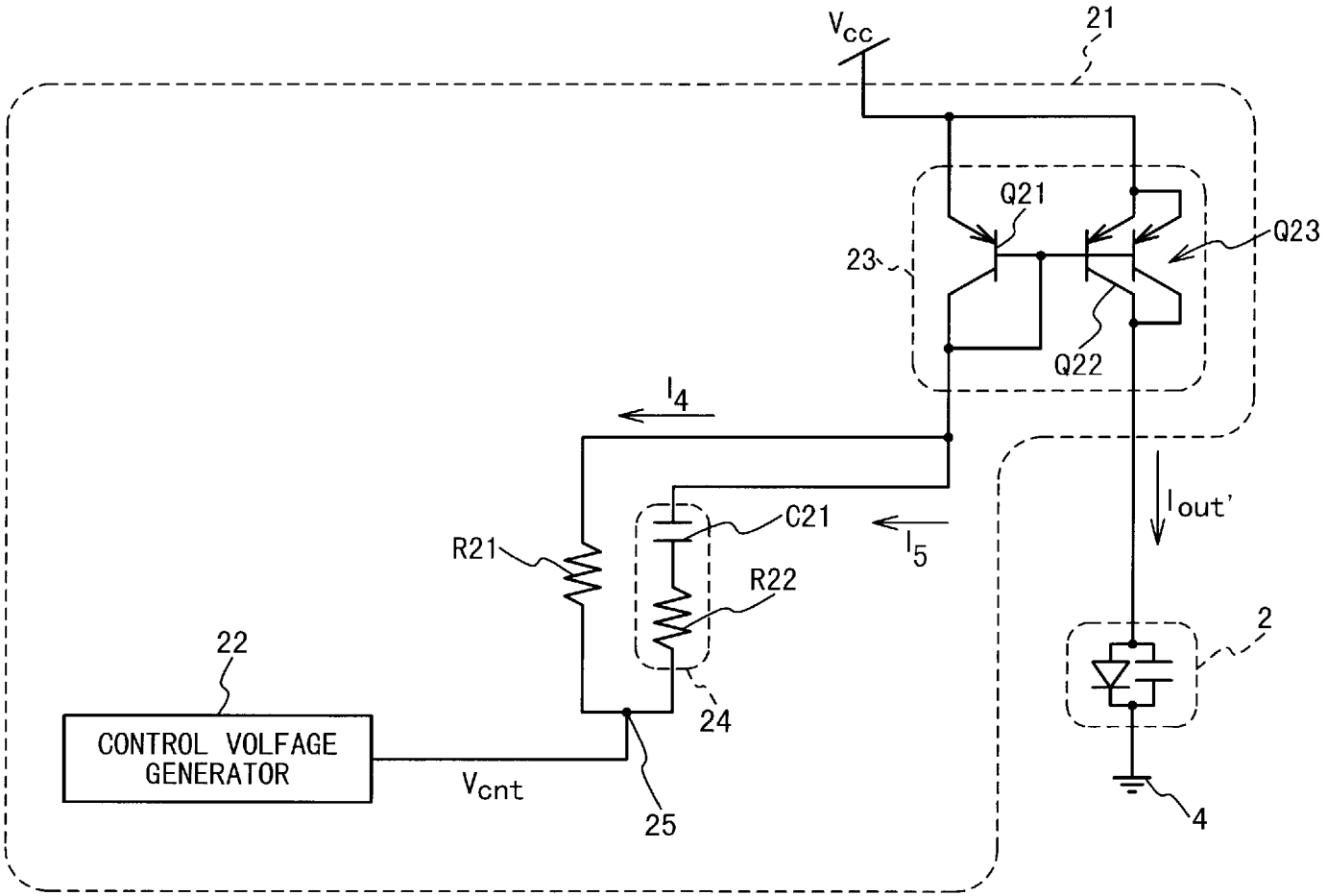
FIG. 12 shows a configuration of a driving circuit 21 of an EL display in a second embodiment.

The second embodiment uses a driving circuit 21 having a configuration shown in FIG. 12, instead of the driving circuit 1 in the first embodiment. The driving circuit 21 is provided with a control voltage generator 22, a current mirror 23, a differentiating circuit 24 and a resistor R21. The control voltage generator 22 outputs a control voltage $V_{cnt}$ to a node 25. The node 25 is connected to one terminal of the resistor R21. The other terminal of the resistor R21 is connected to the current mirror 23. A current $I_4$ flows from the current mirror 23 to the resistor R21.

The node 25 is further connected to the differentiating circuit 24. The differentiating circuit 24 contains a resistor R22 and a condenser C21 which are connected in series. The resistor R21 and the differentiating circuit 24 are connected parallel to each other. The differentiating circuit 24 is connected to the current mirror 23. The current $I_5$ flows from the current mirror 23 to the differentiating circuit 24.

The current $I_6$, in which the current $I_4$ and the current $I_5$ are superimposed on each other, flows from the current mirror 23 to the control voltage generator 22. The current mirror 23 has transistors Q21 to Q23. The current mirror 23 outputs a current equal to d times the current $I_6$ as the drive current $I_{out}$ to the control voltage generator 22.

The operation of the driving circuit 21 will be described below.

Figure 13A:
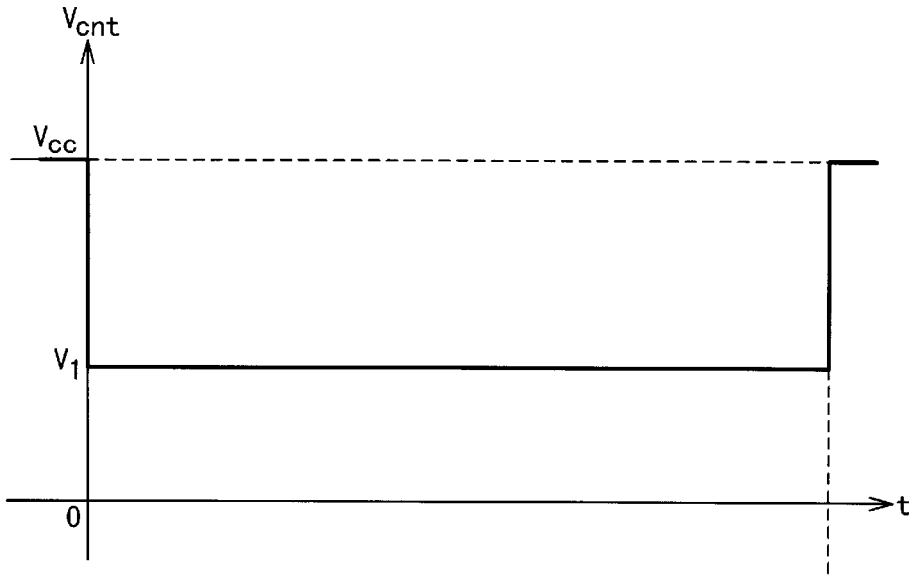
FIG. 13A is a timing chart showing an operation of the driving circuit 21.

As shown in FIG. 13A, at an initial state, he control voltage $V_{cnt}$ is set at the same oltage as a power supply potential $V_{cc}$.

When the drive current $I_{out}$ is outputted to the organic EL pixel 2, the control voltage $V_{cnt}$ is set at a voltage $V_1$ lower than the power supply potential $V_{cc}$. At a time t=0, when the control voltage $V_{cnt}$ is set at the voltage $V_1$, the currents are represented by:

$$I_4=(V_{cc}-V_{BE}-V_1)/R_{21},$$

$$I_5=I_{peak}\cdot\exp(-t/\tau).$$

$$I_{out'}=d\cdot I_6=d\cdot(I_4+I_5)$$

Here, $$I_{peak}=(V_{cc}=V_{BE}-V_1)/R_{22},$$

$$\tau=R_{22}\,C_{21},$$

where $V_{BE}$ is a forward voltage of a base-emitter junction of the transistors Q21, $R_{21}$ and $R_{22}$ are the resistance of the resistors R21, R22, respectively, $C_{21}$ is the capacitance of the capacitor C21.

Here, $I_{peak}=(R_{21}/R_{22})\cdot I_4$

Thus, $I_5=(R_{21}/R_{22})\cdot I_4\cdot\exp(-t/\tau)$

Figure 13B:
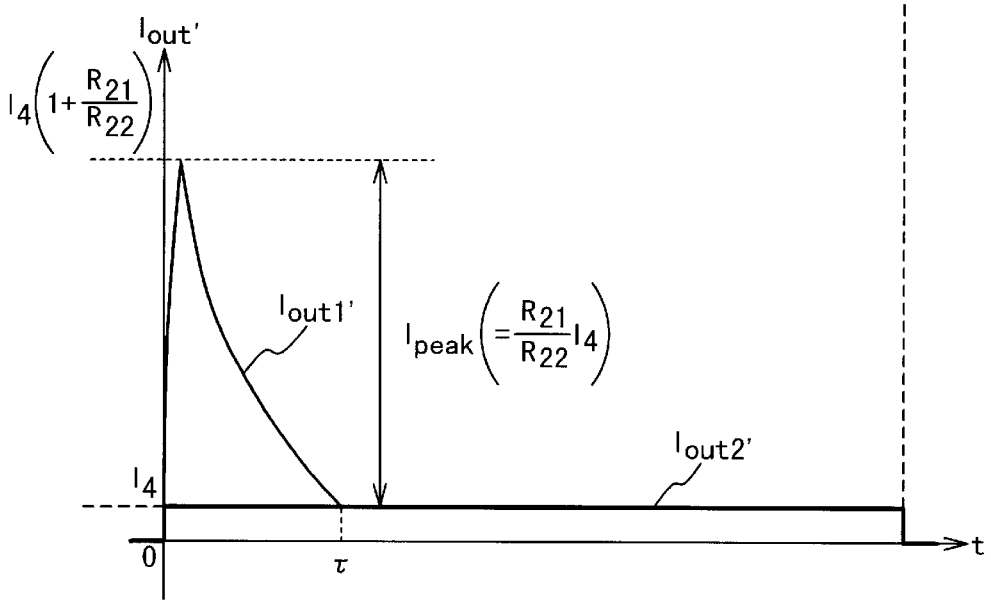
FIG. 13B shows a waveform of a drive current $I_{out}'$.

FIG. 13B shows the waveform of the drive current $I_{out}'$. Let us suppose that the drive current $I_{out}'$ in a range of $0<t<\tau$ is a current $I_{out1}'$. The current $I_{out1}'$ is represented by $$I_{out1}'=d\cdot I_4\{1+(R_{21}/R_{22})\exp(-t/\tau)\}.$$

In the range of $0<t<\tau$, the current $I_{out1'}$ is outputted to the organic EL pixel 2, and the parasitic capacitor included in the organic EL pixel 2 is charged at a high speed.

On the other hand, let us suppose that the drive current $I_{out'}$ in a range of $t>\tau$ is a current $I_{out2'}$. The current $I_{out2}'$ is represented by $$I_{out2'}=d\cdot I_{4,}=d\cdot(V_{cc}-V_{BE}-V_1)/R_{21}.$$

The current $I_{out2}'$ is determined such that the organic EL pixel 2 emits the light at a desirable intensity. The voltage $V_1$ is determined such that the current $I_{out2}'$ is outputted to the organic EL pixel 2 on the basis of d, $V_{cc}$, $V_{BE}$ and $R_{21}$.

Here, $$I_{out1}=I_{out2}'\cdot\{1+(R_{21}/R_{22})\exp(-t/\tau)\}.$$

That is, the current $I_{out1}'$ is determined depending on the current $I_{out2}'$. The current $I_{out1}'$ is determined such that the greater the current $I_{out'2}$, the greater the current $I_{out1}'$. That is, it is designed such that as the organic EL pixel 2 emits the light at a higher intensity, the current $I_{out1'}$ becomes greater. Thus, the EL display in the second embodiment can increase the contrast of the EL display, similarly to the first embodiment. Moreover, in the EL display in the second embodiment, it is possible to reduce the influence from the ambient temperature.

As mentioned above, the present invention provides a technique for increase the contrast of the EL display according to the present invention.

Also, the present invention provides an EL display having the shorter time necessary for the light emission and also having the high contrast.

Also, the present invention provides an EL display that is not easily susceptible to the influence from the ambient temperature.

Moreover, the present invention provides an EL display that has the shorter time necessary for the light mission and is not easily susceptible to the influence from the ambient temperature.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An electroluminescence display comprising:

an electroluminescence pixel; and a driving circuit which drives said electroluminescence pixel to emit light, wherein said driving circuit provides a first drive current, and then provides a second drive current for said electroluminescence pixel, and said first drive current is larger than said second drive current, and increases depending on said second drive current.

2. The electroluminescence display according to claim 1, wherein said second drive current is determined based on a brightness of said light.

3. The electroluminescence display according to claim 1, wherein said first drive current is smaller than a limit current for maintaining a current-brightness property of said electroluminescence pixel substantially linear.

4. The electroluminescence display according to claim 1, wherein said first drive current is k times as large as said second drive current, where k is a constant larger than 1.

5. The electroluminescence display according to claim 4, wherein said k is defined such that $$k\leqq I_{max}/I_{out2\text{-}max},$$

where $I_{max}$ is a limit current for maintaining a current-brightness property of said electroluminescence pixel substantially linear, and $I_{out2\text{-}max}$ is a maximum value of said second drive current.

6. The electroluminescence display according to claim 4, wherein said k is determined based on a color of light emitted by said electroluminescence pixel.

7. The electroluminescence display according to claim 1, wherein said driving circuit includes:

a first current source unit generating a first current, a second current source unit generating a second current, and a current output unit superposing said first and second current to generate said first drive current.

8. The electroluminescence display according to claim 7, wherein said current output unit generates said second drive current from said first current.

9. A method of operating a electroluminescence display comprising:

providing a first drive current with a electroluminescence pixel; and providing a second drive current with said electroluminescence pixel after said providing said first drive current, wherein said first drive current is larger than said second drive current, and increases depending on said second drive current.

10. The method according to claim 9, wherein said second drive current is determined based on a brightness of light emitted by said electroluminescence pixel.

11. The method according to claim 9, wherein said providing said first drive current includes:

generating a first current, generating a second current, and superposing said first and second current to provide said first drive current, and said providing said second drive current includes outputting said first current to provide said second drive current.

12. The method according to claim 9 wherein said first drive current is smaller than a limit current for maintaining a current-brightness property of said electroluminescence pixel substantially linear.

* * * * *